United States Patent [19]

Gabriel

[11] Patent Number: 5,073,686

[45] Date of Patent: Dec. 17, 1991

[54] KNIFE SWITCH

[75] Inventor: Claude D. Gabriel, King of Prussia, Pa.

[73] Assignee: Bombardier Corporation, Bensalem, Pa.

[21] Appl. No.: 586,555

[22] Filed: Sep. 21, 1990

[51] Int. Cl.[5] ..... H01H 1/42

[52] U.S. Cl. ..... 200/254; 200/15; 200/554

[58] Field of Search ..... 200/254, 48 K, 48 B, 200/554, 555, 15, 16 F, 51 R; 191/8, 39; 439/188, 189, 274, 261, 332, 171, 172

[56] References Cited

U.S. PATENT DOCUMENTS

| | | | |
|---|---|---|---|
| 849,684 | 4/1907 | Hewlett | 200/554 X |
| 901,423 | 10/1908 | Cormick | 200/554 X |
| 1,212,161 | 1/1917 | Getts | 200/48 KB |
| 2,226,385 | 12/1940 | Ramsey | 200/254 X |
| 2,513,649 | 7/1950 | Jensen | 200/15 |
| 4,249,045 | 2/1981 | Spaderna | 200/15 |

*Primary Examiner*—Henry J. Recla
*Assistant Examiner*—Glenn T. Barrett
*Attorney, Agent, or Firm*—Dann, Dorfman, Herrell and Skillman

[57] ABSTRACT

A bar providing a switching member is pivotally connected to a terminal supported within an insulating housing. In normal operating position the knife switch is closed to two switch contacts which allow connection of power from one of the contacts to two types of circuits, such as propulsion and the auxiliary circuits of a railway car. The insulating housing may be provided with a cover which is closed when the switch is in normal closed circuit operating position. To change the position of the switch, the cover must be opened. The bar may be pivoted somewhat less than 180° to engage a single contact which connects the power to one of the circuits, but not the other, for example, only to the auxiliary circuit of a railway car. The knife switch is prevented from moving 180° by an end wall of the housing. But in that position it closes to one contact so that it may be viewed as being closed to power the auxiliary circuit. When in other positions, the switch is also viewed as in non-operating open position. However, the bar is provided with a bug stud extending transverse to the direction of movement of the knife switch in operation. The bug stud may be engaged by a shop power connector enabling the auxiliary circuit to be energized without using the normal power source. The connector interferes with the edge of the box so that the knife switch is not capable of being closed in either direction when the shop power connector is engaged.

5 Claims, 2 Drawing Sheets

KNIFE SWITCH

The present invention relates to a knife switch and more particularly to a knife switch having use in connection with rail cars and like applications.

BACKGROUND OF THE INVENTION

The knife switch in single or multiple blade form is one of the older and better known types of switch. Knife switches have application to many places in the railroad industry in particular. Such switches have been used in connection with individual rail cars for simultaneously connecting separated terminals. For example, a knife switch may connect both the auxiliary circuits and the propulsion circuits to power, commonly at 600 volts DC, from a third rail or pantagraph. Since the knife switch is a conductor and the terminals with which it engages are conductors, none of which are covered with insulators, it has been common to enclose the knife switch in an insulator box or enclosure when the car is in normal use. To disconnect the knife switch it is ordinarily necessary to open the cover permitting access to the knife switch and using the insulating handle to pull the switch away from the terminals.

It has been common to employ an alternative closed position for the knife switch involving just one instead of two terminals whereby the auxiliary circuits may be connected to shop power. Sometimes this arrangement involves essentially a 180° rotational shift in position from the energization of both the auxiliary and the propulsion circuits to the position in which only the auxiliary circuits are employed. Commonly the switch enclosure box is too short to permit full closure of the knife switch so that the cover of the insulating housing can not be closed. This makes apparent when using power for only auxiliary circuits that the knife switch is not in position to allow power to be provided to the propulsion circuit.

There are times when it is desirable to use power from the third rail or from the pantagraph to run the auxiliary circuits without the propulsion circuits connected. For example when doing maintenance on the car in the yard on grade level track or just keeping the car in layover mode on a side track. In this case it is likewise desirable to have the cover open to make it apparent that only auxiliary circuits are energized. It is also necessary for equipment and personnel safety that it be impossible to simultaneously connect shop power to the same circuits. To do so would connect the 600 volt shop power to the 600 volt third rail. Their tolerances are quite wide and voltage sources can differ by 300 volts, thus causing arcing, equipment damage and possible maintenance operator injury.

THE NATURE OF THE PRESENT INVENTION

The present invention is directed to provision of means on the knife switch enabling a shop power connector to be attached easily and conveniently without any possibility of connecting shop power to third rail voltage while at the same time preventing the switch from being closed and rendering apparent to anyone who is monitoring the situation that shop power is being applied to the auxiliary circuits.

More specifically the present invention relates to a knife switch having a blade terminal for connection to auxiliary equipment circuits and a pivoted blade conductively connected to the blade terminal. A pair of power terminals having means to engage the blade connection to the propulsion power source located on opposite sides of the blade terminal. A third terminal for connection to the propulsion system is aligned with one of the power terminals so that when the knife blade is engaged with the third terminal the blade is also engaged with one of the power terminals. An insulator support is provided for all of the terminals supported by part of a box enclosure for the terminals, said box permitting closure of the blade in one direction to connect both propulsion and auxiliary circuits to the power source or alternatively permitting connection of only the auxiliary system to the propulsion power source. A bug stud is conductively supported on the blade so oriented that a bug stud connector connected to shop power cannot engage the bug stud unless the blade is outside of the insulator box and once engaged the bud stud connector interferes with the box so that the blade cannot be moved inside the box while the bug stud connector is connected.

THE DRAWINGS

For a better understanding of the present invention, reference is made to the accompanying drawings in which.

SPECIFIC DESCRIPTION OF THE INVENTION

Figure 1:
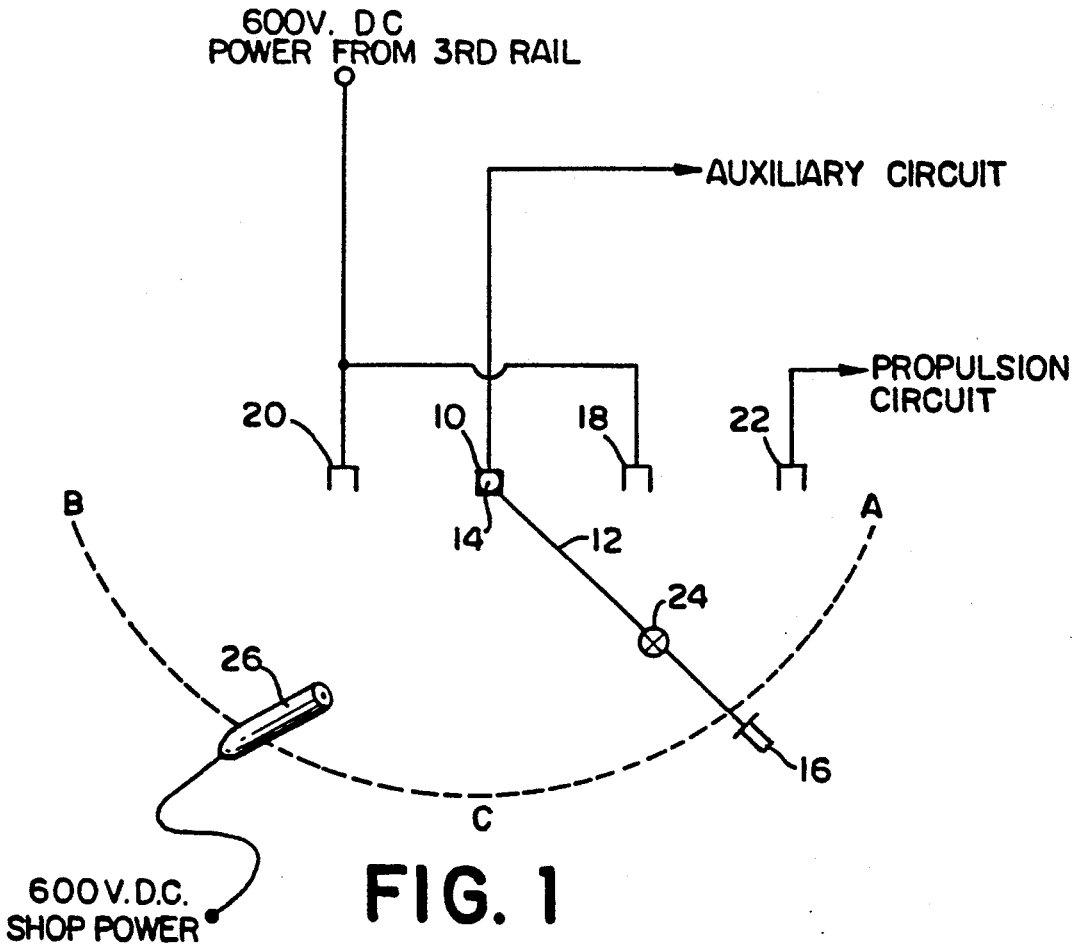
FIG. 1 is a partial circuit diagram showing electrical connections intended for use with the knife switch of the present invention.

The knife switch shown diagrammatically in FIG. 1 includes a terminal 10 providing rotational connection to knife blade or bar conductor 12 through a pivot pin 14 maintaining electrical connections. As illustrated the terminal 10 is connected to auxiliary circuits. The bar of the knife switch blade is terminated in an insulating handle 16 by which the switch may be moved from position A to position B, somewhat less than 180°. Power from the third rail is connected both to terminal 18 and terminal 20 so that in either position A or B the auxiliary circuits are connected to power. A pair of terminals 18 and 22 engage the knife blade in closed position A. Terminal 22 connected to the propulsion circuit is aligned with the power terminal 18 so that when the knife switch is closed in position A it will contact both terminals 18 and 22 and cause the power from the third rail to be connected both to the auxiliary circuit and the propulsion circuit. When the knife switch is rotated about its pivot 14 to position B engaging terminal 20, power from the third rail will be applied only to the auxiliary circuit. In positions in between, such as position C, the knife switch bar 12 will not be connected to any of the terminals 18, 20 or 22. However, switch bar 12 is provided with a bug stud 24, easily seen in FIGS. 2 through 4, which is arranged to receive a connector 26 connected to shop power to thereby energize the auxiliary circuit through shop power.

Figure 2:
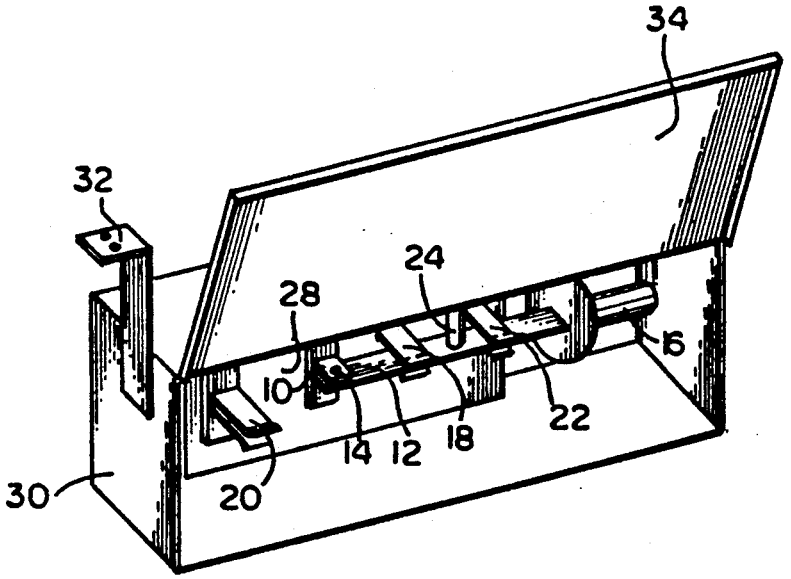
FIG. 2 is a perspective view of a knife switch in accordance with the present invention closed for normal operation within an insulating housing.
Figure 3:
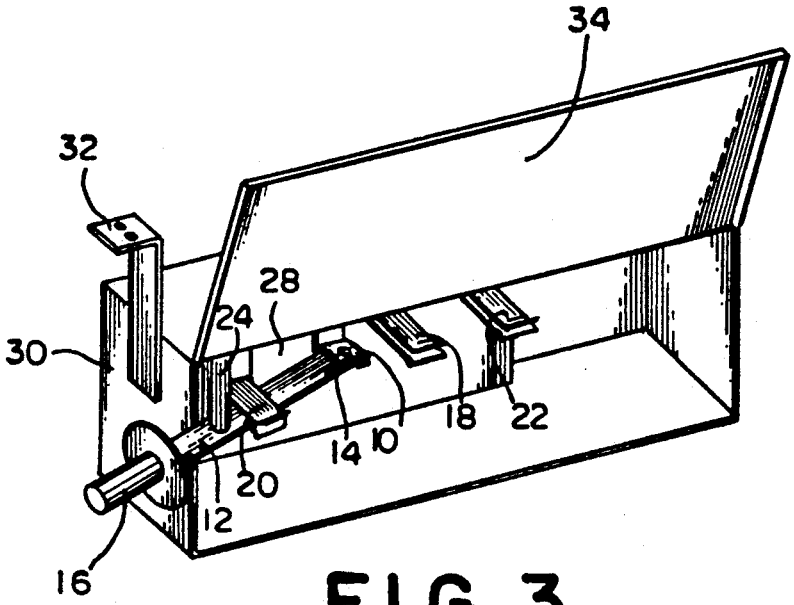
FIG. 3 is a showing of the knife switch of FIG. 2 moved essentially 180° whereby power from the third rail or pantagraph is connected to the auxiliary circuits.
Figure 4:
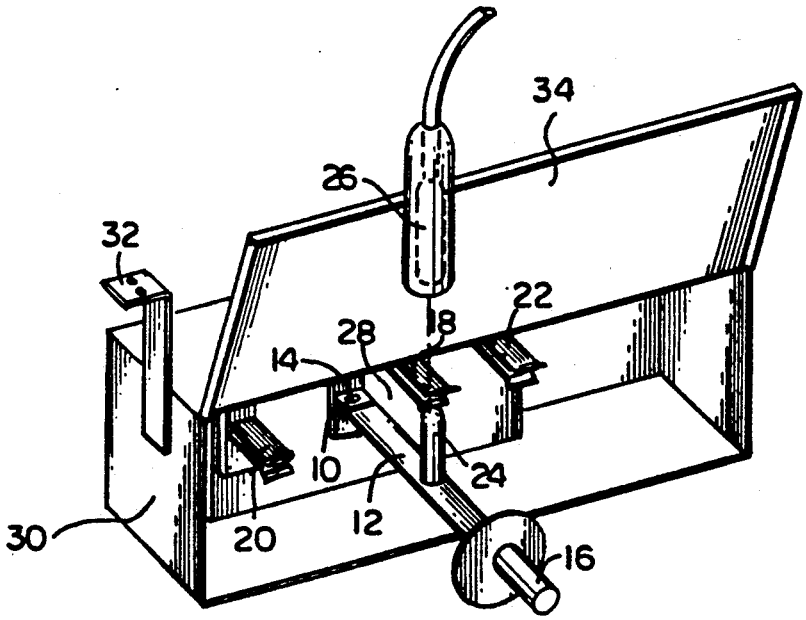
FIG. 4 shows the switch disconnected from the normal switch connections allowing it to be connected to third rail or pantagraph power but permitting it to be connected to shop power using a shop power connector.

Referring now to FIGS. 2, 3 and 4, the same circuit elements are shown in a preferred physical form. In particular, the terminals are all supported on insulator board 28 which typically is mounted on the bottom of an open elongated insulator box 30 which may be supported by suitable brackets 32 from the underside of a railway car in a position not to be easily accessible. The box 30 opens to one side. A hinged cover 34 is hinged at an edge of the box opening and preferably oriented to be the top open edge of the box. When open in the position shown, the box permits access to the switch. It will be understood that ordinarily this cover is closed when the switch is in operating position shown in FIG. 2. The switch is opened from that position as shown in order to disconnect all power as shown in FIG. 4 or rotated to position B of FIG. 1 as seen in FIG. 3 so that it is closed to connect only the auxiliary circuits to third rail power. The terminals of a conventional knife switch are of well known form. However, it will be understood that the terminals which cooperate with the blade are ordinarily pairs of spring metal conductive elements which are flared, or cause to diverge away from one another, just at the free end of the terminal in order to facilitate access of the bar 12 between the spring metal pieces for better electrical connection. As will be seen in FIG. 3 the box is not sufficiently long to permit the knife blade 12 and handle 16 to be moved fully into the box in position B when the blade 12 is in contact with terminal 20. Terminal 20 for this reason may be extended somewhat further out toward the opening of the housing enclosure. The cover cannot be closed in this position so that it will be apparent to an observer that the switch is in a special position for making tests.

When power from the third rail is not available or for some other reason auxiliary power from the shop is desired to be used, in accordance with the present invention, it can be applied through the bug stud 24 using the shop power connector 26. The bug stud connector can be any of a variety of standard connectors and the bug stud need not be precisely a cylindrical stud 24 shown. But preferably the bug stud is a conductor oriented transverse to the movement of the knife such that when the shop power connector 26 is put in position, it will make impossible the closing of the switch to any of its normal positions because the shop power connector on the bug stud will interfere with the edges of the box 30 and hold the blade 22 out of contact with other terminals. Certainly it will make use of shop power apparent because the cover 34 cannot be closed when the shop power is being employed.

As will be apparent to those skilled in the art, there are various possibilities and combinations of terminals and the terminals may be used for purposes other than those specifically specified here. By way of example the invention is therefore capable of application in other areas and may take specifically different forms from that shown in the drawings. Modifications to the structure or electrical connections are to be anticipated, as will be understood by those skilled in the art. All such modifications are intended to be within the scope of the claims and are intended to be within the scope and spirit of the present invention.

I claim:

1. A knife switch comprising:

a conductive blade terminal for connection to a first circuit;

a pivoted conductor blade conductively connected to the blade terminal;

a first contact connectable to a first power source and positioned to be engaged by the blade in a closed position;

a second contact positioned also to be engaged by the blade when in said closed position and connected to a second circuit;

an insulator support for the blade terminal and said contacts to hold them in operative position;

a conductive bug stud supported on the conductor blade generally transverse to the plane of movement of the blade wherein said bug stud is adapted to be connected to a connector to a second source of power; and an interfering insulator member positioned to normally permit passage of the bug stud and the blade to said closed position, said insulator member preventing passage of the bug stud and the blade to said closed position when said connector to a second power source is attached to the bug stud.

2. The knife switch of claim 1 in which the interfering insulator is a box enclosure.

3. The knife switch of claim 2 in which the box enclosure is provided with a cover which closes the box when the blade is in the closed position and engaged with the two contacts and the cover cannot be closed when the second source of power connector is engaged with the bug stud.

4. A knife switch comprising a blade terminal connectable to an auxiliary circuit;

a conductive blade conductively and pivotably connected to the blade terminal;

a pair of power contacts having means to engage the blade and connectable to a main power source, said contacts being located on opposite sides of the blade terminal and engaged by the blade in alternate positions;

a third contact connectable to a propulsion circuit and aligned with one of the power contacts so that the blade is engaged with the third contact when the blade is also engaged with one of the power contacts;

an insulator support for supporting all of the contacts, said support being part of an insulator box enclosure, said box enclosure permitting movement of the blade in one direction to connect the propulsion and auxiliary circuits to the power source or alternatively permitting movement in another direction such that only the auxiliary circuit and the power source are connected; and a bug stud conductively supported on the blade and so oriented that a bug stud connector connected to shop power cannot engage the bug stud unless the blade is oriented outside the insulator box whereby the bug stud connector when connected to shop power interferes with the box such that the box prevents the blade from being moved into contact with the power contacts and third contact positioned inside the box.

5. The knife switch of claim 4 in which the box enclosure is provided with a cover which closes the box when the blade is engaged with the power contact and the third contact, said cover cannot be closed when the bug stud is connected to shop power.

* * * * *